United States Patent [19]

Shida

[11] Patent Number: 4,920,935

[45] **Date of Patent: * May 1, 1990**

[54] HYDRAULIC VALVE LASH ADJUSTER

[75] Inventor: Toshimitsu Shida, Fujisawa, Japan

[73] Assignee: Fuji Valve Co., Ltd., Tokyo, Japan

[ * ] Notice: The portion of the term of this patent subsequent to Dec. 19, 2006 has been disclaimed.

[21] Appl. No.: 332,598

[22] Filed: Apr. 3, 1989

[30] Foreign Application Priority Data

Jul. 13, 1988 [JP] Japan ..... 63-92857[U]

[51] Int. Cl.[5] ..... F01L 1/24

[52] U.S. Cl. ..... 123/90.51; 123/90.55

[58] Field of Search ..... 123/90.35, 90.5, 90.51, 123/90.55, 90.56, 90.57

[56] References Cited

U.S. PATENT DOCUMENTS

| | | | |
|---|---|---|---|
| 2,688,319 | 9/1954 | Humphreys | 123/90.55 |
| 2,938,508 | 5/1960 | Papenguth | 123/90.59 |
| 3,838,669 | 10/1974 | Dadd | 123/90.35 |
| 4,004,558 | 1/1977 | Scheibe | 123/90.35 |
| 4,437,439 | 3/1984 | Speil | 123/90.55 |
| 4,584,976 | 4/1986 | Hillebrand | 123/90.55 |
| 4,607,599 | 8/1986 | Buente et al. | 123/90.5 |
| 4,711,202 | 12/1987 | Baker | 123/90.55 |
| 4,747,376 | 5/1988 | Speil et al. | 123/90.55 |
| 4,756,282 | 7/1988 | Kunz et al. | 123/90.55 |
| 4,771,741 | 9/1988 | Leer | 123/90.5 |

FOREIGN PATENT DOCUMENTS

| | | | |
|---|---|---|---|
| 0205735 | 12/1986 | European Pat. Off. . | |
| 2343269 | 3/1975 | Fed. Rep. of Germany . | |
| 0032112 | 2/1988 | Japan | 123/90.55 |
| 0170509 | 7/1988 | Japan | 123/90.55 |

OTHER PUBLICATIONS

Patent Abstracts of Japan, vol. 10, No. 304 (M-526)(2360), Oct. 16, 1986; JP-A-61 118,509.

*Primary Examiner*—David A. Okonsky
*Assistant Examiner*—Weilun Lo
*Attorney, Agent, or Firm*—Cushman, Darby & Cushman

[57] ABSTRACT

The present invention relates to a hydraulic valve lash adjuster which is capable of storing a large quantity of oil therein and exhibits high resistance to wear. In the valve lash adjuster in accordance with the invention, the plunger comprises an upper plunger portion and a lower plunger portion, and the upper and lower plunger portions are welded together with the partition member so that the partition member is sealingly fixed within the plunger. Accordingly, the upper and lower plunger portions are welded together, and simultaneously the partition member is sealingly fixed within the plunger. The plunger thus formed is surface hardened by quenching or carburizing. With the above construction of the invention, therefore, the hardness of the outer surface of the plunger is not impaired and the residual stresses generated by welding do not degrade the resistance to wear and fatigue.

3 Claims, 4 Drawing Sheets

HYDRAULIC VALVE LASH ADJUSTER

BACKGROUND OF THE INVENTION

1. Field of the Invention

The present invention relates to a hydraulic valve lash adjuster, and more specifically, to a hydraulic valve lash adjuster which is capable of storing a large quantity of oil therein and exhibits high resistance to wear.

2. Description of Related Art

The plunger of a hydraulic valve lash adjuster is provided with an internal reservoir for oil storage because oil cannot be instantly supplied from the exterior to the valve lash adjuster when the engine is started. Thus the oil stored in the reservoir provides a source of oil for use at the re-starting of the engine.

However, in a case where the valve lash adjuster is limited in length due to the design of the engine, or the valve lash adjuster has to be installed with a certain degree of inclination, the reservoir of the valve lash adjuster is unable to store an amount of oil sufficient for the re-starting of the engine. In order to eliminate such a disadvantage, it has been proposed to provide a generally cylindrical partition member within the plunger comprising an upper plunger portion and a lower plunger portion so as to increase the reservoir capacity.

Generally, the plunger of a valve lash adjuster performs rapid reciprocating movements relative to the body of the adjuster under the action of a cam during the operation of the engine. Since an inexpensive material such as carbon steel is used for manufacture of a plunger, the outer surface of the plunger has to be hardened by quenching or carburizing to avoid wear of the outer surface of the plunger due to its contact with the inner surface of the body.

Referring to FIG. 1, there is shown a conventional hydraulic valve lash adjuster comprising a cylindrical body 11 and a hollow plunger 12. The plunger 12 includes two portions, an upper plunger portion 12*a* and a lower plunger portion 12*b*. The upper plunger portion 12*a* is provided therein with a generally cylindrical partition member 21. The partition member 21 is inserted into the upper plunger portion 12*a* so as to define a space between itself and the plunger wall, and is secured at its lower end in fluid tight sealing engagement with the inner surface of the upper plunger portion 12*a* by means of press fitting. The upper plunger portion 12*a* is welded at its lower end to the upper end of the lower plunger portion 12*b*.

In manufacture of the plunger, the upper and lower plunger portions 12*a*, 12*b* are treated in advance by quenching or carburizing. The surface hardened portions 33 of the upper and lower plunger portions 12*a*, 12*b* at the regions to be welded are removed to facilitate welding. Then the partition member 21 is mounted in the upper plunger portion 12*a* before the upper and lower plunger portions 12*a*, 12*b* are welded together by, for example, projection welding. After the welding of the two portions, the plunger thus formed is incorporated into the body 11.

Due to the fact that the two members constituting the plunger are welded together after the surface hardening, the surface hardness of the portions 33 of the upper and lower plunger portions adjacent to the welded portion 31 is seriously impaired and the residual stresses generated in the portions 33 by welding can degrade resistance to wear and fatigue.

Furthermore, during the operation of the valve lash adjuster, spatter particles 32 projecting inward from the welded portion 31 may come off and fall into the reservoir 20. As a result, the operation of a check valve 14 in the form of a ball can be impaired and the plunger can no longer perform smooth reciprocating movements within the body 11.

Turning to FIG. 2, there is shown a hydraulic valve lash adjuster of another type which includes a cylindrical body 11 and a hollow plunger 12. Components similar to those of the valve lash adjuster shown in FIG. 1 are given the same reference numerals as in FIG. 1.

The valve lash adjuster shown in FIG. 2 is identical in construction to the one shown in FIG. 1 in that the plunger 12 includes an upper plunger portion 12*a* and a lower plunger portion 12*b*, that the upper plunger portion 12*a* is provided therein with a partition member 21, and that the partition member 21 is inserted in the upper plunger portion 12*a* in the manner as described above.

In the valve lash adjuster shown in FIG. 2, however, the upper plunger portion 12*a* is not welded at its lower end either to the lower end of the partition member 21 or to the upper end of the lower plunger portion 12*b*, but the lower end faces of both the upper plunger portion 12*a* and the partition member 21 are merely in contact with the upper end face of the lower plunger portion 12*b*. In other words, the valve lash adjuster shown in FIG. 2 is different in construction from one shown in FIG. 1 in that the upper and lower plunger portions are not joined together.

The upper and lower plunger portions 12*a*, 12*b* are treated in advance by quenching or carburizing before being incorporated into the body as in the lash adjuster shown in FIG. 1. Then, the partition member 21 is inserted in the upper plunger portion 12*a* before the upper plunger portion 12*a* is incorporated into the body 11 with the lower end face of the upper plunger portion 12*a* in contact with the upper end face of the lower plunger portion 12*b*.

In the conventional valve lash adjuster shown in FIG. 2, since the upper plunger portion 12*a* is not in fluid tight sealing engagement with the lower plunger portion 12*b*, the oil stored in the reservoir 20 up to the level indicated by an arrow A can escape along the arrows to the exterior of the body 11, and consequently decreases down to the level indicated by the arrow B. Moreover, the upper plunger portion 12*a* is not welded to the lower plunger portion 12*b* but is merely in contact at its lower end face with the upper end face of the lower plunger portion 12*b*. As a result, the plunger, particularly the upper plunger portion thereof, is in contact with the body over a relatively short length, and therefore, the upper plunger portion cannot carry a sufficient magnitude of lateral load at its upper end.

Furthermore, since the upper plunger portion cannot carry sufficient lateral load, the size of the valve lift, and consequently the design of the engine is induly limited.

SUMMARY OF THE INVENTION

Accordingly, it is an object of the invention to eliminate the above-mentioned disadvantages and provide a hydraulic valve lash adjuster in which the plunger is subject to surface hardening after the plunger and partition member are welded together so that the hardness of the outer surface of the plunger will not be impaired and so that the residual stresses generated by welding will not degrade the resistance to wear and fatigue.

The above and other objects of the present invention can be achieved by a hydraulic valve lash adjuster which includes a cylindrical body, a hollow plunger slidably received within the body and having a reservoir formed therein, a generally cylindrical partition member placed within the plunger to increase the reservoir capacity, and check valve means for permitting oil to flow only from a reservoir into a high-pressure chamber defined between the bottom wall of the body and the bottom wall of the plunger, characterized in that the plunger comprises an upper plunger portion and a lower plunger portion, and the upper and lower plunger portions are welded together with the partition member so that the partition member is sealingly fixed within the plunger.

Accordingly, the upper and lower plunger portions are welded together, and simultaneously the partition member is sealingly fixed within the plunger. The plunger thus formed is surface hardened by quenching or carburizing. With the above construction of the invention, therefore, the hardness of the outer surface of the plunger is not impaired and the residual stresses generated by welding do not degrade the resistance to wear and fatigue.

In a preferred embodiment of the invention, the partition member is welded by projection welding to the upper and lower plunger portions, and the lower end of the partition member extends beyond the joint between the two plunger portions to define a space between the lower portion of the partition member and the wall of the lower plunger portion. In such a valve lash adjuster, since spatter particles are confined within the space thus defined and are prevented from coming off the welded portion and falling into the reservoir, the operation of the check valve and cosequently the smooth reciprocating operation of the plunger is not impaired.

In another specific embodiment of the invention, the partition member is welded to the upper and lower plungers by plasma welding, TIG arc welding, electron beam welding or laser beam welding.

The above and other objects, features and advantages of the present invention will become apparent from the following detailed description of preferred embodiments of the present invention with reference to the accompanying drawings.

DESCRIPTION OF THE PREFERRED EMBODIMENTS

Figure 1:
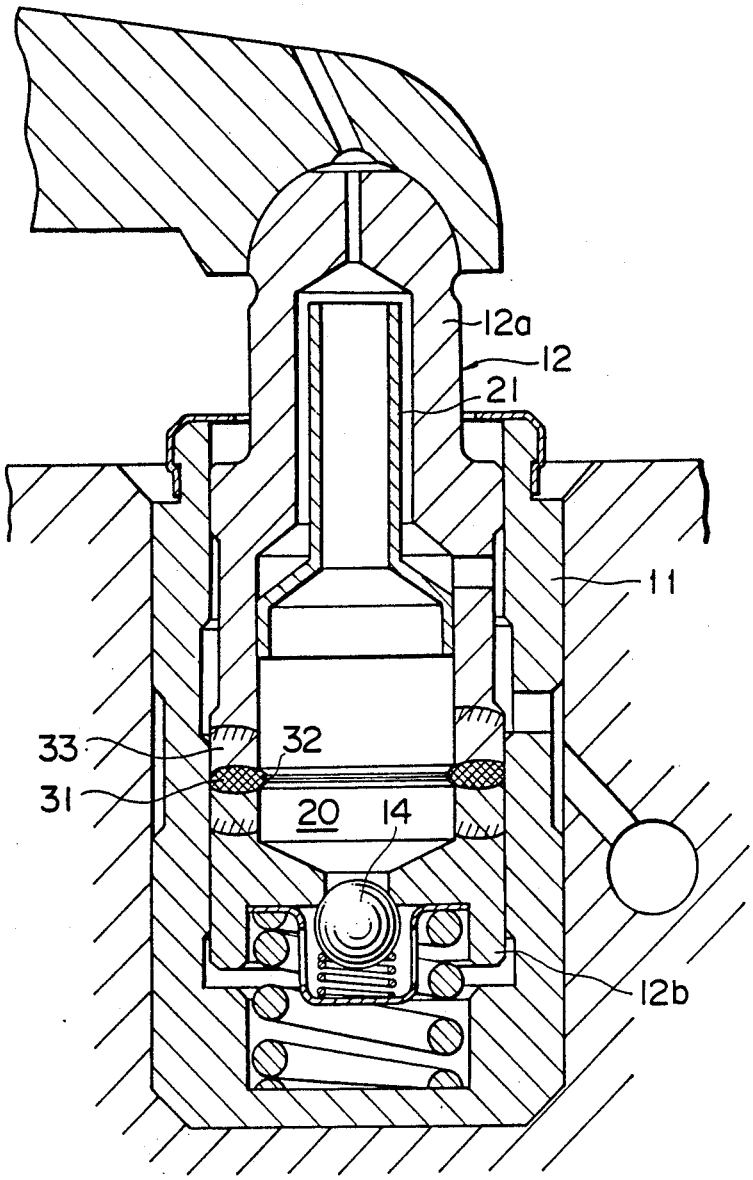
FIG. 1 (PRIOR ART)
FIG. 1 is a cross sectional view showing the construction of a conventional hydraulic valve lash adjuster.
Figure 2:
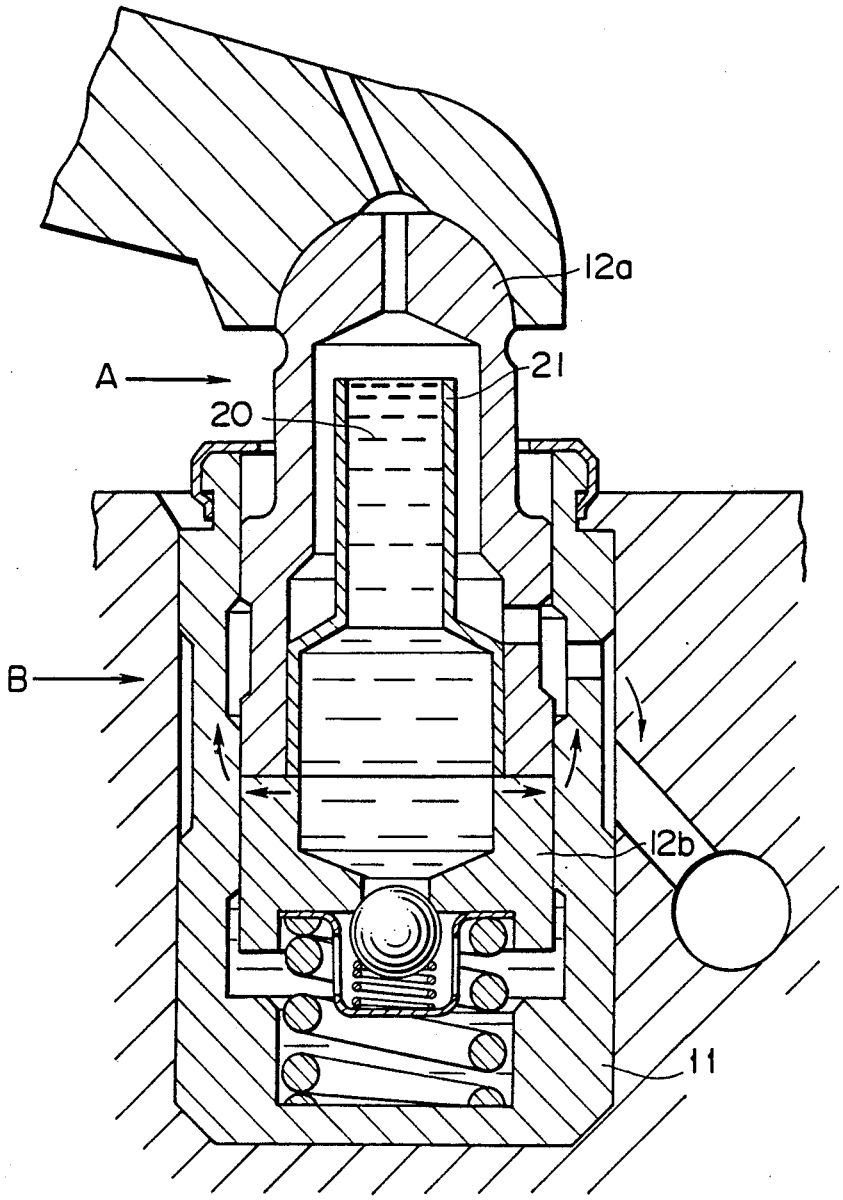
FIG. 2 (PRIOR ART)
FIG. 2 is a cross sectional view showing the construction of a conventional hydraulic valve lash adjuster of another type.
Figure 3:
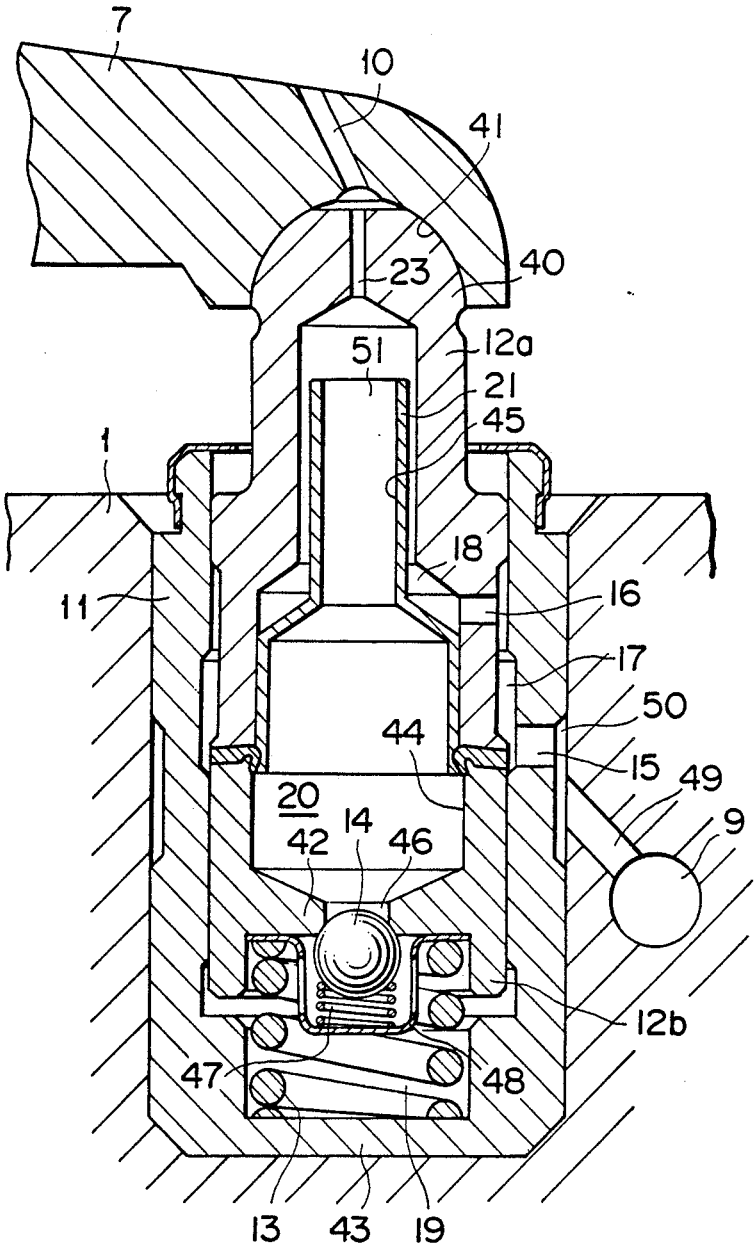
FIG. 3 is a cross sectional view showing the construction of a hydraulic valve lash adjuster constructed in accordance with the present invention.

Referring to FIG. 3, there is shown a hydraulic valve lash adjuster constructed in accordance with the present invention. Components similar to those of the valve lash adjuster shown in FIG. 1 are given the same reference numerals as in FIG. 1.

The shown hydraulic valve lash adjuster includes a cylindrical body 11 which is fitted within a cylinder head 1 and a hollow plunger 12 which is slidably received within the body 11. The plunger 12 includes two portions, an upper plunger portion **12*a* and a lower plunger portion 12*b***.

The upper plunger **12*a* is provided therein with a generally cylindrical partition member 21 which is inserted in the upper plunger portion 12*a* so as to define a space with the inner surface of the wall of the upper plunger portion 12*a* and secured at the lower portion in fluid tight sealing engagement with the inner surface of the wall of the upper plunger portion 12*a* by press fitting. The upper plunger portion 12*a* is welded at its lower end to the upper end of the lower plunger portion 12*b* and to the lower end of the partition member 21**.

The upper plunger portion **12*a* is formed at its upper end with a semi-spherically shaped upper end 40 which is slidably received within and in contact with a spherically concaved recess 41 in a rocker arm 7. A high-pressure chamber 19 is defined between the bottom wall 42 of the lower plunger portion 12*b* and the bottom wall 43 of the body 11. A reservoir 20 is defined by the inner surface 44 of the wall of the lower plunger portion 12*b* and the inner surface 45 of the partition member 21**.

In the high pressure chamber 19, a return spring 13 is incorporated vertically between the bottom wall 42 of the lower plunger portion **12*b* and the bottom wall 43 of the body 11 to bias upwardly the plunger. The lower plunger portion 12*b* has an outlet port 46 centrally formed in the bottom wall 42 thereof. A check valve in the form of a ball 14 is held in place against the bottom wall 42 of the lower plunger portion 12*b* by another return spring 47 to close the outlet port 46. The return spring 47 is held in place by a retaining member 48 which is in turn held by the previously described return spring 13**.

The cylinder head 1 is formed with an oil gallery 9, which communicates through a channel 49 with an annular channel 50 defined between the cylinder head 1 and the body 11. The annular channel 50 in turn communicates through a first inlet 15 with another annular channel 17 defined between the body 11 and the upper plunger portion **12*a***.

The annular channel 17 communicates through a second inlet 16 further with an oil-introducing chamber 18 which is defined between the inner surface of the wall of the upper plunger portion **12*a* and the outer surface of the wall of the partition member 21. The chamber 18 communicates through the upper opening 51 of the partition member 21 with the reservoir 20. The upper plunger portion 12*a* is formed at its semi-spherically shaped end 40 with an oil discharge orifice 23, which in turn communicates with a passage 10 formed in the rocker arm 7**.

Figure 4A:
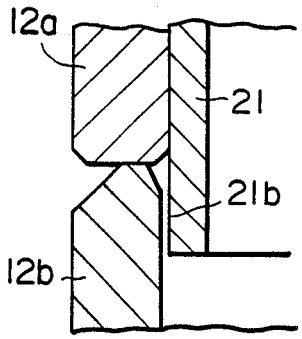
FIGS. 4A and 4B are enlarged cross sectional views respectively showing the construction of the joint of the plunger before welding and after welding.
Figure 4B:
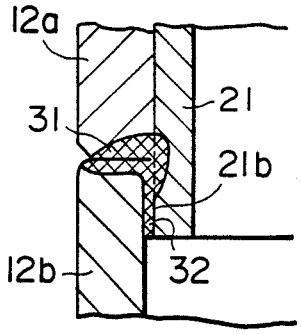

The upper plunger portion **12*a* and lower plunger portion 12*b* constituting the plunger 12 are separately formed. The partition member 21 is inserted into the upper plunger portion 12*a* so that the lower portion of the partition member 21 is secured in fluid tight sealing engagement with the inner surface of the wall of the plunger by press fitting. The partition member 21 is seized such that the lower end 21*b*** extends beyond the joint between the upper and lower plunger portions as best shown in FIG. 4A.

Thus, the lower ends of the upper plunger portion 12*a*, the upper end of the lower plunger portion 12*b* and the lower end of the partition member 21 are welded together by means of projection welding or other appropriate welding. In case of projection welding, as shown in FIG. 4A, the welding condition such as pressure and electric current applied to the two plunger portions is appropriately selected so that a welded portion or melted portion 31 penetrates into the wall of the partition member 21.

Spatter particles 32 generated by projection welding is confined within a space defined between the lower end 21*b* of the partition member 21 and the upper plunger portion 12*a*. After the upper and lower plunger portions are welded together for formation of the plunger, it is subjected to an appropriate surface hardening process such as quenching.

Thus the chamber 18 communicates only through the upper opening 51 of the partition member 21 with the reservoir 20.

In operation, oil under pressure is supplied through the oil gallery 9 to the hydraulic valve lash adjuster where the oil flows through the first inlet 15, annular channel 17, and second inlet 16 into the chamber 18. The oil thus introduced into the chamber 18 then flows through the upper opening 51 of the partition member 21 into the reservoir 20.

A portion of the oil is discharged through the oil discharge orifice 23 and the passage 10 to the exterior so as to effect lubrication of a cam which is not shown in the figures. The oil discharge orifice 23 also serves to discharge air introduced within the valve lash adjuster.

When the engine is stopped, the oil in the gallery 9 will drop into an oil pan (not-shown). Furthermore, the oil in the first inlet 15, annular channel 17, second inlet 16 and chamber 18 gradually leaks out into the gallery 9, and as a result, oil remains only within the reservoir 20. Thus, the oil is stored to the level of the upper end face of the divider member 21. The oil thus stored in the reservoir 20 is sufficient to meet the need for oil consumption within the high-pressure chamber 19 at the restarting of the engine.

Figure 5:
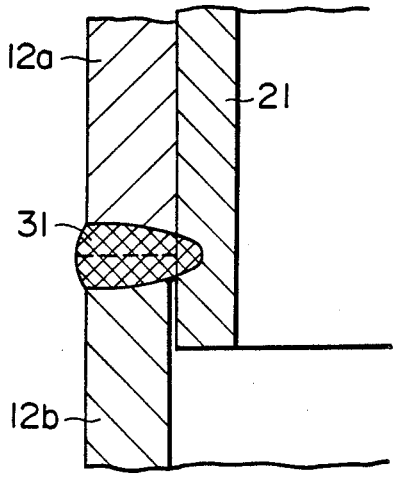
FIG. 5 is an enlarged cross sectional view of the welding portion showing the construction of a melted portion to which plasma welding, TIG arc welding, electron beam welding or laser beam welding is applied.

FIG. 5 shows the construction of a melted portion to which plasma welding, TIG arc welding, electron beam welding or laser beam welding is applied. The resulting melted portion 31 extends substantially in a horizontal direction to penetrate into the wall of the partition member 21.

Accordingly, in a hydraulic valve lash adjuster in accordance with the present invention, the plunger is constituted by an upper plunger portion and lower plunger portion, and the two portions are welded together with the partition member so that the partition member is sealingly fixed within the plunger. Thus, the plunger can be subjected to an appropriate surface hardening treatment before incorporation into the body.

Although the invention has thus been shown and described with reference to specific embodiments, it should be noted that the present invention is in no way limited to the details of the illustrated structures but changes and modifications may be made within the scope of the appended claims.

I claim:

1. A hydraulic valve lash adjuster which includes a cylindrical body; a hollow plunger slidably received within the body and having a reservoir formed therein; a generally cylindrical partition member placed within the plunger to increase the reservoir capacity; and check valve means for permitting oil to flow only from the reservoir into a high-pressure chamber defined between the bottom wall of the body and the bottom wall of the plunger; characterized in that the plunger comprises an upper plunger portion and a lower plunger portion, and the upper and lower plunger portions are welded together with the partition member so that the partition member is sealingly fixed within the plunger.

2. A hydraulic valve lash adjuster as set forth in claim 1, wherein the partition member is welded by projection welding to the upper and lower plunger portions, and the lower end of the partition member extends beyond the joint between the two plunger portions to define a space between the lower portion of the partition member and the wall of the lower plunger portion.

3. A hydraulic valve lash adjuster as set forth in claim 1, wherein the partition member is welded to the upper and lower plungers by plasma welding, TIG arc welding, electron beam welding or laser beam welding.

* * * * *